United States Patent [19]

Supkis

[11] 4,038,046

[45] July 26, 1977

[54] COATED ABRASIVE BONDED WITH UREA-FORMALDEHYDE, PHENOLIC RESIN BLENDS

[75] Inventor: Stanley J. Supkis, Averill Park, N.Y.

[73] Assignee: Norton Company, Worcester, Mass.

[21] Appl. No.: 645,522

[22] Filed: Dec. 31, 1975

[51] Int. Cl.[2] ..... C08J 5/14
[52] U.S. Cl. ..... 51/295; 51/298 A
[58] Field of Search ..... 51/295, 298; 260/840

[56] References Cited

U.S. PATENT DOCUMENTS

| | | | |
|---|---|---|---|
| 3,256,077 | 6/1966 | Abler | 51/298 |
| 3,306,864 | 2/1967 | Lang et al. | 260/840 |
| 3,619,150 | 11/1971 | Rinker et al. | 51/295 |
| 3,852,232 | 12/1974 | Bowman et al. | 260/840 |

*Primary Examiner*—Donald J. Arnold
*Attorney, Agent, or Firm*—Rufus M. Franklin

[57] ABSTRACT

Abrasive articles containing abrasive grits bonded to a support are made with a resinous bond consisting of urea formaldehyde prepolymer blended with a phenolic A-stage resin and finally cured under basic conditions.

7 Claims, No Drawings

COATED ABRASIVE BONDED WITH UREA-FORMALDEHYDE, PHENOLIC RESIN BLENDS

BACKGROUND OF THE INVENTION

This invention relates to abrasive articles in which a thin layer or, more usually, a single layer of abrasive grit is adhesively bonded to a backing. Such products are coated abrasives, more commonly referred to as "sandpaper", and fibrous abrasive pads such as disclosed in U.S. Pat. No. 2,958,593 (Hoover et al.). Conventionally, animal glue or thermosetting resins such as phenol formaldehyde resins and urea formaldehyde resins have been used as either the maker coat (first bonding coat) or size coat (second bonding coat). The most common resinous bond for coated abrasives has been the phenolic resin, which is usually filled, in the maker coat, with finely particulate calcium carbonate. Urea formaldehyde resins, which are less expensive than phenolic resins, have been used to reduce the cost of such products, in the size coat. Since urea formaldehyde precondensates employed to make coated abrasives require an acid catalyst, it has not been feasible to employ calcium carbonate filler with urea formaldehyde resins.

SUMMARY OF THE INVENTION

The present invention resides in the discovery that the cheaper urea formaldehyde precondensates can be blended with liquid phenolic resin systems, the blend can be catalyzed by providing a basic environment (pH above 7), rather than the acid catalyst specified for unblended urea formaldehyde prepolymers and a finished product at least equal in quality to that achieved when a straight phenolic resin is employed. Such blends can be employed in both the maker and size coats, and when employed in the size coat, reduce the loading tendency of the product when grinding certain materials, such as wood.

The blend of urea formaldehyde liquid precondensate and phenolic resin precondensate may vary from 10 parts of urea formaldehyde to 90 parts of phenolic solids, by weight to 90 parts of urea formaldehyde to 10 parts of phenolic. The curing time and temperature is the same as conventionally used with phenolic resins, and calcium carbonate filler can be employed in the maker coat and, if desired, in the size coat.

The backing can be any conventional fibrous woven, or non-woven material such as cotton or synthetic cloth, felted fibrous material such as paper or so-called vulcanized fiber, and open, lofty non-woven fibrous material as disclosed in the Hoover et al patent.

The abrasive may be any conventional abrasive suited for making coated abrasive products, such as fused alumina, cofused alumina zirconia, silicon carbide, garnet, emery and flint.

SPECIFIC EMBODIMENTS OF THE INVENTION

EXAMPLE I

In this example of the invention is used a non-woven backing which contains a fiber blend containing 75% by weight, 15 denier nylon 1½ inches staple and 25% 15 denier polyester 1½ inches staple. This fiber blend is bonded with a pigmented melamine modified butadiene styrene latex. The binder content is 1.3 lbs./ream dry on each face of the non-woven web. The total fiber content of this backing is 71 grams per square yard. This binder is cured for 1½ minutes at 275° F + 3 minutes at 275° F at the end of the second coat. This backing is approximately ⅜ inches thick and weighs 8.27 lbs./ream. It is open, soft and green colored.

This bonded web was coated with a slurry containing Beetle 7238-20 (urea formaldehyde condensate from American Cyanamid Co.) 24.35 parts dry weight; a resol (A-stage) phenol formaldehyde resin (F/P ratio of 2.1 l) 14.45 parts dry weight; water 13.94 parts; yellow dye 0.49 parts; blue dye 0.50 parts; water 1.50 parts; and grit 320 aluminum oxide abrasive grain 44.26 parts. The viscosity of this mixture was determined at room temperature and was found to give 10 secs. in a No. 5 Zahn cup. The total solids is 71.4% and the pH is between 7 and 10.

The slurry was applied to backing web by a two-roll coater with wet pickup applied to the backing of 38.9 lbs./ream (330 square feet). After the coated web was cured for 6 minutes at 650° F the cured product weighed 35.8 lbs./ream.

This product was tested according to Interim Federal Specification 00-P-0040C for floor polishing machines and found to give an average of 7.77 grams cut by the Schieffer cut test.

This product was tested as a hand pad for polishing pots and pans and was found to be very satisfactory.

EXAMPLE II

A standard greige cotton fabric in a 2 × 1 twill construction having a yarn count of 76 × 48 with warp and fill yarn numbers having 12' s/l cotton warp and 17' s/l cotton filling weighing 7 oz./sq. yd. was finished by applying a backsize of 51%, 58 mp. glue to the backing which is dried by conventional means to a total dried weight of deposition of 2.0 lbs./ream. After the web had been so dried a second coating was applied to the front side of the fabric containing a resol phenol formaldehyde resin containing 76% active material (Varcum 2535, having F/P ratio of 2.08/l) sold by Reichhold Chemical Company 275 lbs. calcium carbonate 200 lbs. and water 30 lbs. Said second solution giving a viscosity of 2100 cps. at 80° F. The second solution was applied by inverted knife coating technique to a dry deposition of 6.3 lbs./ream.

To this prepared backing a maker coat of adhesive was applied by roll coater, said maker coat containing a mixture of basic catalyzed formaldehyde resins; the first phenol formaldehyde material had a formaldehyde to phenol ratio of 2.08 and the second phenol formaldehyde resin had a formaldehyde to phenol ratio of approximately 0.95. These phenolic constituents which were basic (pH above 7) were mixed with a urea formaldehyde condensate (Beetle 7238-20) and calcium carbonate filler. The exact weight ratios of these components were phenolic (2.08) 7.4 lbs.; phenolic (0.95) 3.2 lbs.; urea formaldehyde resin 8.3 lbs. and calcium carbonate filler, 21.4 lbs. This mixture was adjusted with water to a viscosity of 6300 cps. at 100° F. The pH was between 7 and 10.

The amount of maker adhesive applied to the backing member was 21 lbs./ream. The backing member with the making coat of adhesive thereon was fed through a sandpaper making machine in which grit 50 aluminum oxide abrasive grain was applied in two steps. In the first step, 19.2 lbs./ream were applied by a gravity method and in the second, 20.8 lbs./ream were applied by an electro-coating method. After the abrasive grain had been applied to the web it continued into a festoon drying and curing oven where the coated abrasive web was cured for 25 minutes at 170° F, 25 minutes at 190° F, and 57 minutes at 225° F.

The fabric with the maker coat of adhesive plus abrasive grain which had been cured is now given a second coat of adhesive which contains a mixture of phenol formaldehyde resins similar to the maker adhesive but without the urea formaldehyde component. The exact formulation of the second coat of adhesive which is applied over the abrasive grain contains phenol formaldehyde condensate (F/P ratio 2.08) 28.7 lbs.; phenol formaldehyde condensate (F/P ratio 0.95) 12.3 lbs.; calcium carbonate (average particle diameter 14.9 microns) 49.3 lbs., and water 9.7 lbs. The viscosity of this second coat of adhesive measures 550 cps. at 100° F. The second coat of adhesive is usually applied visually by a skilled operator so that points of abrasive grain are not completely covered by the second coat of adhesive. Usually the amount of adhesive is 16 lbs./ream. After the coated abrasive web has received a second coat of adhesive, it then proceeds into a sandpaper curing oven and is cured at 25 minutes at 125° F, 25 minutes at 135° F, 18 minutes at 180° F, 25 minutes at 190° F, 15 minutes at 225° F, and 8 hours at 230° F.

After the material is cooled to room temperature and emerges from the sandpaper making machine it then receives a number of finishing treatments to aid in curl correction of the product.

This product was tested on a bench backstand machine with a test designed to determine its shed resistance. The results show that a conventional coated abrasive belt lasted 3.87 minutes compared with belts made from the maker adhesive of this invention, had an improved shed resistance over the control and lasted a period of 5.25 minutes.

This test is designed to show the shed resistance of the coated abrasive product and also to give an evaluation of the base adhesion between the maker adhesive and the backing member.

Instead of the straight phenolic size employed above, the maker (without abrasive, and with or without filler) may be diluted with water to give a viscosity of 550 cps. at 100° F.

The phenolic resins useful in this invention are A-stage, or resol phenolics, that is alkaline catalyzed one-step fusible thermo-setting resins. A typical preparation of such a resin is as follows:

EXAMPLE III

| | | |
|---|---|---|
| Formulation: | Phenol | - 43.07 lbs. |
| | Formaldehyde (44%) | - 66.93 lbs. |
| | Caustic soda (50%) | - .353 lbs. |
| | Amt. of distillate | - 28.50 lbs. |
| | Yield | - 85 lbs. |

The phenol and initial formaldehyde, 0.77 lbs. are added to the kettle and the stirrer is started. Vacuum is set at 20 in. The heater is turned on to a jacket temperature of 325° F, when the batch temperature reaches 140° F, the heat is turned off and the caustic is added. Vacuum is used to control the total temperature at 205° F. The batch temperature raises when the caustic is added. When refluxing begins, formaldehyde addition is stirred slowly and increased to 0.4 lb./min. Reflux time starts when batch temperature reaches 205° F and is held at this temperature for 20 minutes. Vacuum is then applied to return batch temperature to 185° F. The temperature is held at 185° F until the batch viscosity reaches 83–85 cps. at 77° F. Full vacuum is applied to reduce the temperature. When full vacuum is reached, the dehydration step begins with a jacket temperature of 400° F. Cool with vacuum reflux and jacket cooling.

The product has the following specifications:

Solids — 71–76%

Viscosity — 2500–6000 cps.

$H_2O$ tolerance — 600–1100% pH — 8.7–9.0

The urea formaldehyde resins useful in my invention are conventional commercially available acid catalyzed fusible reaction products of urea and formaldehyde. Typical are resins available from Georgia Pacific Corporation such as XMP-C-37, GP1988, GP19889 and GP3441.

Likewise conventional A-stage (alkaline catalyzed) phenolic resins, including bis-phenol types, are suitable.

The urea formaldehyde resins may be modified, such as the furfurylated resins commercially available.

A typical preparation of a urea formaldehyde resin is as follows:

EXAMPLE IV

To 50 grams of formalin (37% formaldehyde) were added 18.6 grams of urea. The pH was adjusted from an initial 4.8 to 8.2 with aqueous NaOH. The mixture was heated at reflux for two hours and then 16 mil of water was removed by distillation at atmospheric pressure over a period of 25 minutes. The pH, which had reached 6.95 was adjusted to 7.6 with aqueous NaOH.

Although the pre-polymer described above is intended to be acid catalyzed (see U.S. Pat. No. 2,983,593) when used alone, and although it is well known that the resol resins which are blended therewith in the present invention can be acid or base catalyzed, an important aspect of the present invention is the polymerization of the blended resins in a basic environment. Such non-acidic environment is essential when a filler such as calcium carbonate is employed in the mixture, because of the basic nature of calcium carbonate.

In general a basic pH between 7 and 10, can be used in this invention. For wood finishing it is preferred that the size coat, at least, be a blend of urea formaldehyde and phenol formaldehyde resins, because of the non-loading character of the urea formaldehyde resins with respect to wood. For grinding with coarse grits, the higher ratios of phenolic to urea resins are preferred, within the range of from 9 to 1 to 1 to 9. Similarly, where the most strengths and resistance to pull out of grits is desired, it is preferred that the size coat be all phenolic or at the higher range of phenolic to urea resins.

What is claimed is:

1. An abrasive product comprising abrasive grits bonded to a fibrous backing by a basic cured condensation product of a urea formaldehyde prepolymer and a phenolic prepolymer resin, the ratio of phenolic prepolymer solids to urea formaldehyde prepolymer solids being from 9/1 to 1/9.

2. An abrasive product as in claim 1 in which the grits are bonded to a nonwoven fibrous backing.

3. An abrasive product comprising abrasive grits bonded to a fibrous backing by a condensation product of a urea formaldehyde prepolymer and a phenolic prepolymer resin, the ratio of phenolic prepolymer solids to urea formaldehyde prepolymer solids being from 9/1 to 1/9, said condensation product includes a particulate calcium carbonate filler.

4. An abrasive product as in claim 1 in which the abrasive grit size is between 600 and 16, and the ratio of urea formaldehyde to phenolic prepolymer is from 9/1 to 1/9, the larger ratio being present when 600 grit is employed the smaller ratio when 16 grit is employed.

5. An abrasive product as in claim 1 which includes a size coat of phenolic resin; grits of 50 and coarser.

6. An abrasive product as in claim 1 which includes a size coat of urea formaldehyde; grits of 80 and finer.

7. A method of making an abrasive product comprising adhering abrasive grits to a fibrous backing by a liquid adhesive which is a mixture of a urea formaldehyde and a phenol formaldehyde prepolymer, said mixture having a pH between 7 and 10, and curing the adhesive by heat.

* * * * *